US008853582B2

(12) United States Patent
Tengler et al.

(10) Patent No.: US 8,853,582 B2
(45) Date of Patent: Oct. 7, 2014

(54) ELECTRICAL SWITCH WITH SHEAR FORCE CONTACT WELD RELEASE

(75) Inventors: Adrian J. Tengler, New Berlin, WI (US); Michael S. Osvatic, Waukesha, WI (US); Michael K. Hintz, Waukesha, WI (US)

(73) Assignee: Illinois Tool Works Inc., Glenview, IL (US)

( * ) Notice: Subject to any disclaimer, the term of this patent is extended or adjusted under 35 U.S.C. 154(b) by 332 days.

(21) Appl. No.: 13/462,576

(22) Filed: May 2, 2012

(65) Prior Publication Data

US 2013/0015049 A1 Jan. 17, 2013

Related U.S. Application Data

(60) Provisional application No. 61/506,869, filed on Jul. 12, 2011.

(51) Int. Cl.

| | |
|---|---|
| ***H01H 1/22*** | (2006.01) |
| ***H01H 5/08*** | (2006.01) |
| ***H01H 13/28*** | (2006.01) |
| ***H01H 3/00*** | (2006.01) |
| *H01H 1/16* | (2006.01) |

(52) U.S. Cl.

CPC ..... *H01H 13/28* (2013.01); *H01H 5/08* (2013.01); *H01H 1/16* (2013.01); *H01H 3/001* (2013.01); *H01H 2300/046* (2013.01)

USPC ..... 200/462; 200/466; 200/467

(58) Field of Classification Search

CPC ..... H01H 9/226; H01H 3/161; H01H 3/162; H01H 3/166; H01H 13/183

USPC ..... 200/462, 466, 467, 557, 61.62, 61.75

See application file for complete search history.

(56) References Cited

U.S. PATENT DOCUMENTS

| | | | | |
|---|---|---|---|---|
| 3,866,201 | A * | 2/1975 | Beiswenger | 340/528 |
| 4,230,919 | A * | 10/1980 | Schantz et al. | 200/462 |
| 6,118,090 | A | 9/2000 | Osvatic | |
| 7,442,894 | B2 * | 10/2008 | Villain et al. | 200/344 |

* cited by examiner

*Primary Examiner* — Renee Luebke
*Assistant Examiner* — Ahmed Saeed

(57) ABSTRACT

An electrical switch provides a center contact moving between two outer contacts, at least one of which is mounted on a lever. In the event of a contact weld forming between the center contact and the lever mounted contact, unison motion of the lever mounted contact following the center contact during switching causes a strong shear force tending to break the weld. In one embodiment, a fulcrum wall striking the lever of the lever mounted contact causes increased angulation between the contacts so that unison motion rotates and peels the contacts apart.

9 Claims, 4 Drawing Sheets

ELECTRICAL SWITCH WITH SHEAR FORCE CONTACT WELD RELEASE

CROSS-REFERENCE TO RELATED APPLICATIONS

This application claims the benefit of U.S. provisional application No. 61/506,869 filed Jul. 12, 2011 hereby incorporated by reference in its entirety

FIELD OF THE INVENTION

The present invention relates to an electrical switch and in particular to an electrical switch for providing a mechanism to break contact welds caused by current surges.

BACKGROUND OF THE INVENTION

Modern appliances such as washing machines and dryers may provide for lid or door switches detecting when the appliance lid or door is open. In many cases, these lid switches serve to help protect the consumer from machinery moving inside the appliance by turning off an appliance motor or otherwise deactivating moving elements of the appliance. Such switches may include a stationary contact disconnecting from a movable contact driven by movement of a switch operator when the lid or door is open. The two contacts may control power to a motor or brake or the like.

Electrical switches normally provide a snap action mechanism so that the contacts of the switch open and close rapidly (to reduce arcing) independent of the speed of movement of the switch operator. One method of providing a snap action is a so-called "over-center spring" attached to a lever holding the movable contact. When the force applied on the lever by the over-center spring crosses the lever pivot (over-center), the torque on the lever rapidly switches direction causing the switch to "snap" between positions. The switch operator normally applies forces to the over-center spring rather than directly to the contact, so that the operator does not interfere with the snap action.

Voltage surges in the power line connected to an appliance can cause high currents through the contacts in switches of this type, welding the contacts together. In such cases, the force of the over-center spring on the welded contact may be insufficient to break the weld, with the result that the switch cannot be turned off. One solution is to increase the strength of the over-center spring, but this may be undesirable to the extent that it increases the operating force necessary to activate the switch, for example, preventing ready door closure. Increasing the strength of the over-center spring may also undesirably tax the other components of the switch.

SUMMARY OF THE INVENTION

The present invention provides a switch suitable for controlling high amperage loads in an appliance that better resists contact welding by allowing movement of the normally stationary contact. When contact welding occurs, unison movement of the welded contacts on their support arms induces a strong shear force across the face of the contacts tending to break any welds. Proper positioning of the support arms provides a high mechanical advantage in generating this shear force reducing the need to increase the strength of the over-center spring and preventing the weld-breaking force from being dissipated in flexure of the arms. An induced relative angulation of the contacts when moving in unison motion past a certain point (which indicates a continued weld) may optionally provide an additional prying leverage that further helps to separate the contacts.

Specifically, the present invention provides an electrical switch having a housing holding a first and second contact, the second contact supported at a distal end of a first lever to move under the influence of a switch operator between a first position separated from the first contact and a second position contacting the first contact. The first contact is supported at a distal end of a second lever which is movably supported by the housing to follow the second contact moving from the second position to the first position when the first and second contacts are connected by a welding. Proximal ends of the first and second levers are positioned in the housing to provide a shear force between a first and second contact when the first contact follows the second contact from the second position to the first position by a welding at the second position.

It is thus a feature of at least one embodiment of the invention to generate strong shear forces between the contacts when a welding occurs to separate the contacts.

The second lever may be a flexible metal strip affixed to the housing at the proximal end of the second lever and movement from the second position to the first position may flex the metal strip to provide resilient resistance of the second lever to follow the second contact.

It is thus a feature of at least one embodiment of the invention to provide a simple method of generating shear forces between the contacts by flexibly mounting a normally stationary contact.

The housing may include a fulcrum wall contacting the second lever at a point between ends of the second lever, when the first contact follows the second contact from the second position to the first position by a welding at the second position, to tip the first contact with respect to the second contact by bending the second lever at the fulcrum wall.

It is thus a feature of at least one embodiment of the invention to increase a relative angular rotation of the contacts if the weld is not broken by an initial shear force to produce a prying action.

The first and second contacts may be outwardly convex to contact at a point.

It is thus an object of the invention to provide a contact surface amenable to a rolling, prying action for separating welded contacts.

The first and second levers may pivot about effective first and second pivot points and the first and second levers extend from the effective first and second pivot points to be substantially parallel to a plane connecting the first and second pivot points.

It is thus a feature of at least one embodiment of the invention to maximize the mechanical advantage acting on the over-center spring force to produce a shear force, thereby avoiding the need to increase the strength of the over-center spring and thus the actuation force of the switch. It is a feature of at least one embodiment of the invention to prevent the weld separating forces from being dissipated in flexure of the levers. By generating the shear force along the lever extensions, compressive or tensile forces are primarily generated in lieu of bending forces.

Other features and advantages of the invention will become apparent to those skilled in the art upon review of the following detailed description, claims and drawings in which like numerals are used to designate like features.

Figure 1:
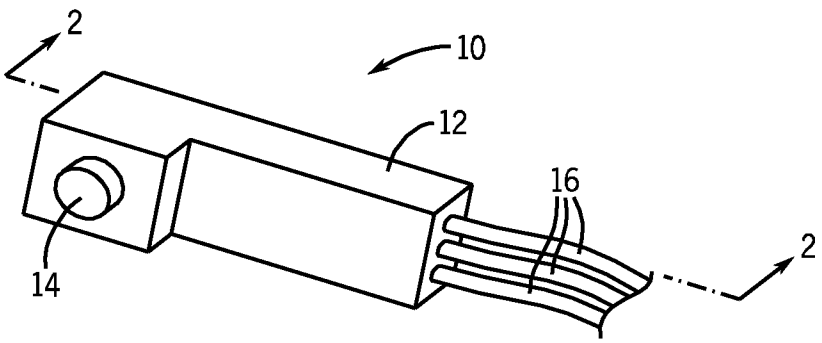
FIG. 1 is a perspective view of one embodiment of a switch per the present invention showing a switch housing having a switch operator extending therefrom for actuation of the switch and having electrical conductors for connecting the switch to other elements such as a motor of an appliance.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to FIG. 1, an electrical switch 10 per the present invention may provide for a housing 12, for example, of an insulating thermoplastic material. The housing 12 may expose therethrough a pushbutton operator 14 that may be pressed inward toward the housing 12 to activate an internal set of contacts to be described. Conductive leads 16 may extend from the housing 12 to communicate with external electrical circuits, for example motors or actuators of a household appliance (not shown).

Figure 2:
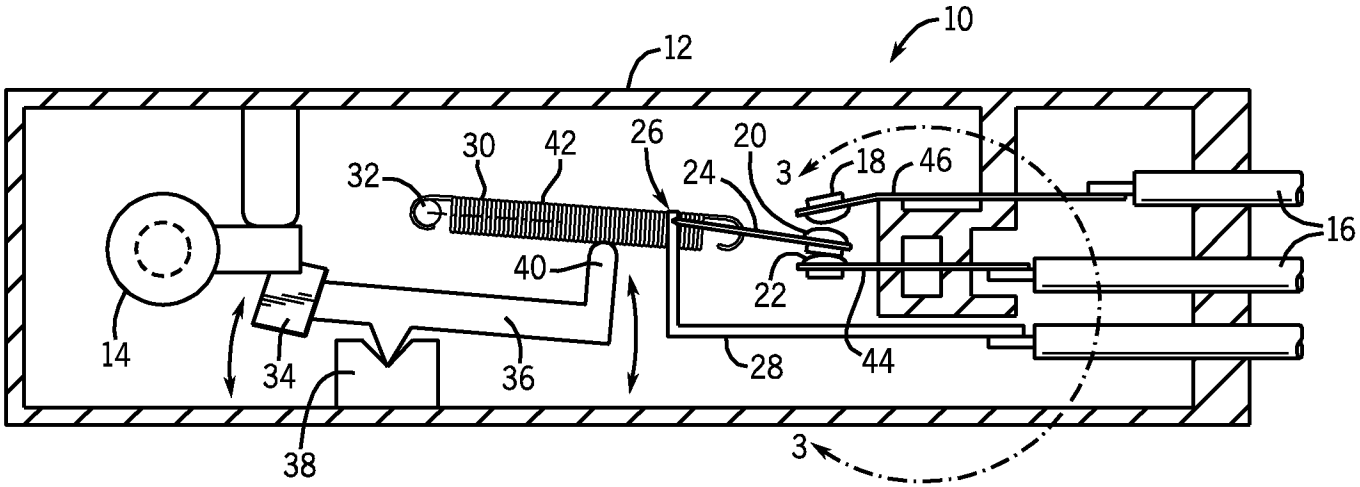
FIG. 2 is an elevational cross-section along line 2-2 in FIG. 1 showing a mechanical linkage between the switch operator and an over-center spring mechanism for moving a center contact between two outer flanking contacts each connected to different of the conductors of FIG. 1, where the lower flanking contact is mounted to be substantially stationary and the upper flanking contact is mounted on a flexible support arm, the switch being shown in a first "safe" state with the operator released.

Referring now to FIG. 2, the electrical switch 10 may contain an upper contact 18, a center contact 20, and lower contact 22 arranged to provide a single pole, double throw electrical switch with the upper contact 18 and lower contact 22 generally flanking the center contact 20. The center contact 20 may move between the upper contact 18 and lower contact 20 to selectively and alternatively connect to only one of the upper contact 18 and lower contact 22.

The center contact 20 may be supported on a relatively rigid conductive lever 24 attached at a knife edge pivot point 26 to a conductive support bracket 28, the latter communicating with one of the conductive leads 16 and pivot point 26 allowing electrical conduction from the conductive lever 24 to the conductive lead 16. By pivoting the lever 24 around the pivot point 26, the lever 24 may be moved upward and downward so that the center contact 20 alternately connects electrically to upper contact 18 and lower contact 22.

A helical over-center spring 30 attaches to a center portion of the lever 24 and extends away from the center contact 20 to a support post 32 on the housing 12 to provide a force on the lever 24 tending to engage the lever 24 and support bracket 28 at the pivot point 26.

The operator 14, when pressed inward (into the page depicting FIG. 2), presses against a wedge plate 34 attached at one end of a rocker arm 36 to rotate the rocker arm 36 counterclockwise about a center positioned fulcrum 38. An opposite end of the rocker arm 36 provides an upwardly extending finger 40 which deflects a center region of the helical over-center spring 30 upward to change its line of action 42 with respect to the pivot point 26. The line of action 42 represents a force vector asserted on the lever 24 by the helical over-center spring 30. As will be discussed in greater detail below, when the line of action 42 is above the pivot point 26, the lever 24 will snap rapidly upward and when the line of action 42 is below the pivot point 26, lever 24 will snap rapidly downward Referring still to FIG. 2, the upper contact 18 and lower contact 22 are each generally supported on a cantilevered conductive metal strip to one of the conductive leads 16. Specifically, the upper contact 18 is supported on a lower distal end of flexible metal lever 46 and the lower contact 22 is supported on an upper distal end of a substantially rigid conductive metal strip 44. Generally the strip 44 and lever 46 extend from their respective contacts 18 and 22 in the opposite direction as the lever 24.

Figure 3:
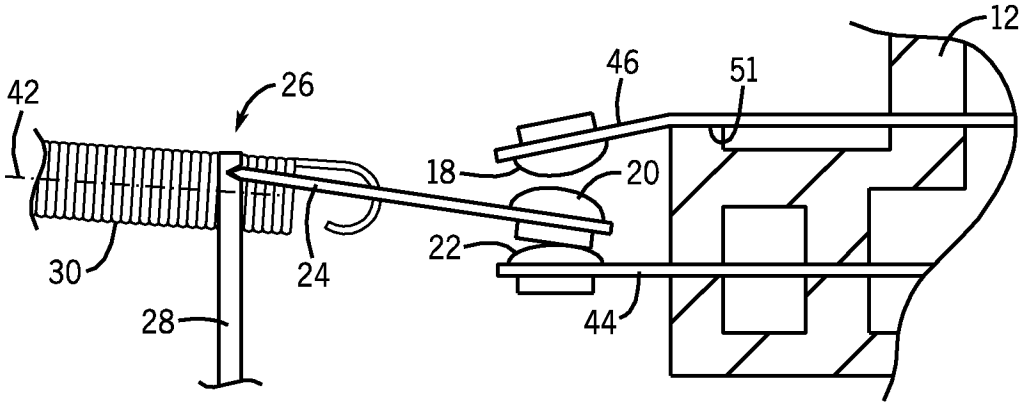
FIG. 3 is a fragmentary detail of FIG. 2 with the switch in a first position providing a safe state with the center contact contacting the lower contact and disconnected from the upper contact which is flexed downward slightly on its support lever.

Referring now to FIGS. 2 and 3, when the operator 14 is released and the rocker arm 36 rotates to its full clockwise position, the line of action 42 of the helical over-center spring 30 moves below the pivot point 26 and a lower surface of the center contact 20 contacts an upper surface of the lower contact 22 at a first position as pulled together by a torsional vector component of the force along the line of action 42 of the over-center spring 30 the force pulling downward on lever 24. An upper surface of contact 20 is separated from a lower surface of the upper contact 18 so that a circuit is "made" between contacts 20 and 22 and "broken" between contacts 20 and 18.

Figure 4:
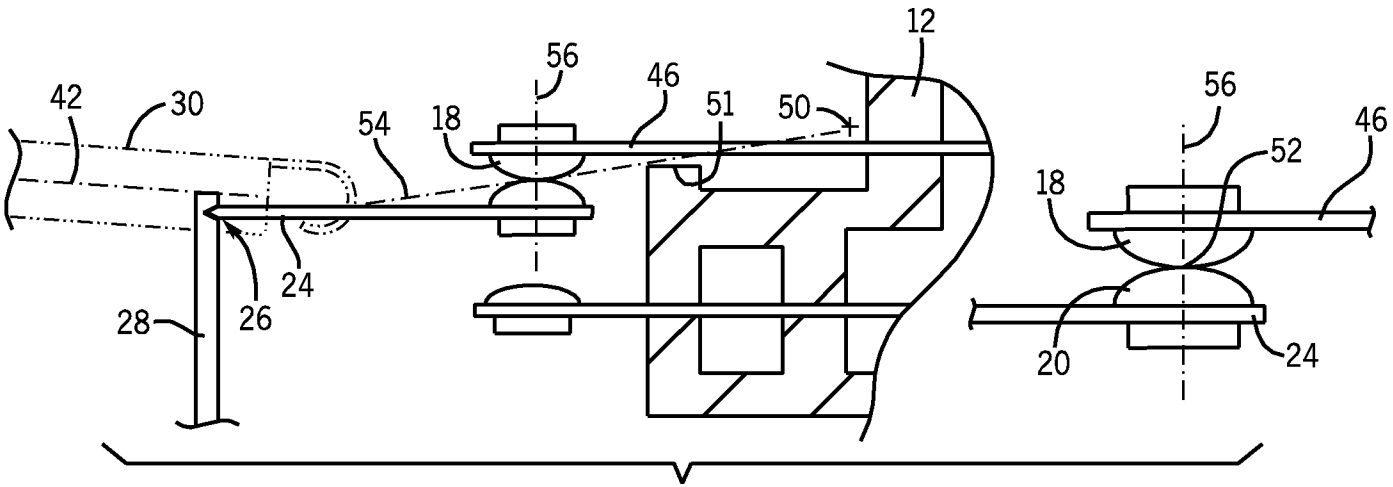
FIG. 4 is a figure similar to that of FIG. 3 with the switch in a second position providing an active state with the operator activated to move the center contact upward to contact the upper contact, the upper contact flexing upward to substantially center itself on the center contact as shown in a juxtaposed detail.

Referring to FIGS. 2 and 4, when the operator 14 is compressed, the rocker arm 36 rotates to a full counterclockwise position pressing upward on the helical over-center spring 30 to move the line of action 42 above the pivot point 26 pulling upward on lever 24 so that an upper surface of contact 22 contacts the lower surface of contact 18 at a second position. Under the force of contact 22, flexible lever 46 is moved from a fulcrum wall 51 contacting a center region of the lower surface of lever 46 allowing the lever 46 to straighten as it rotates about an effective pivot point 50. The effective pivot point 50 is displaced slightly upward from the attachment of the lever 46 to the housing 12 as a result of the distributed flexure of the lever 46 and as differs from the focused pivoting of lever 24 about a discrete pivot point 26.

The opposed surfaces of the upper contact 18 and center contact 20 are outwardly rounded or convex to contact at a contact point 52 generally along a centerline 54 between pivot point 26 and pivot point 50. The contact point 52 is approximately centered on centerlines 56 normal to the face of the contacts 18 and 22 and the levers 24 and 46 are roughly parallel to the centerline 54 as will be discussed below.

Figure 5:
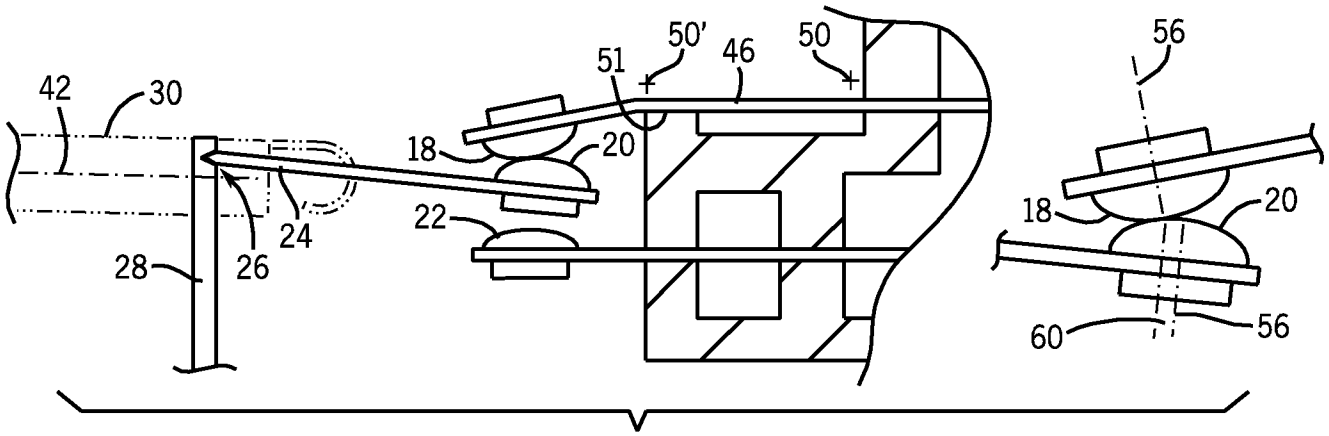
FIG. 5 is a figure similar to FIGS. 3 and 4 showing a release of the operator after a welding of the contacts in the second position of FIG. 4 showing a unison motion of the upper contact and center contact, the upper contact following the center contact downward creating a strong shear force across the contact interface shown in a juxtaposed detail and further showing a bending of the lever holding the upper contact about a fulcrum point on the housing to create a rotation of the upper contact prying the upper and center contacts apart.

Referring now to FIGS. 2 and 5, if a contact weld forms at contact point 52 when the switch 10 is in the second position, at the time when the operator 14 is released, upper contact 18 will follow center contact 20 in unison motion (D) as center contact 20 descends under the force of the over-center spring 30. Specifically, when the operator 14 is released, the rocker arm 36 rotates to the full clockwise position releasing the over-center spring 30 so that the center of action 42 drops below the pivot point 26. The unison motion of the center contact 20 and the upper contact 18 causes the upper contact 18 to try to slide in a direction perpendicular to the center normals 56 by a shear displacement 60 (S) as a result of the relative stiffness in compression of the lever 46 and 24 and the relative locations of pivot point 26 and pivot point 50. This creates a strong sheer force at the interface between the upper contact 18 and the lower contact 20 generally along a plane tangential to their contact point 52.

Figure 8:
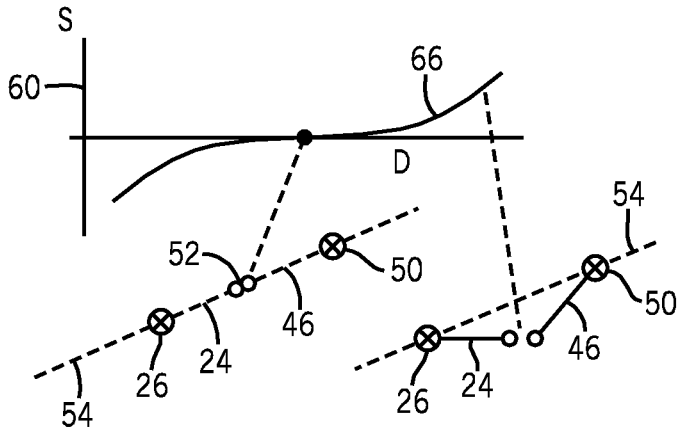
FIG. 8 is a chart showing a shear separation (S) of the contacts as a function of unison movement (D) of the contacts from the second to first position showing the high degree of mechanical advantage obtained when contact between upper and center contacts and the levers holding the upper and center contacts are substantially aligned along a line between pivot points of the levers in the second position.

Referring momentarily to FIG. 8, the amount of shear displacement 60 as a function 66 of unison motion (D) of the upper contact 18 and center contact 20 changes very slowly as the levers 24 and 46 move from a position where the contact point 52 between the upper and lower contacts is centered along the centerline 54 and the levers 24 and 46 are substantially parallel to the centerline 54. This region of low slope of function 66 provides a highest mechanical advantage in converting unison motion (D) under the force of the over-center spring 30 to a shear displacement 60 (S) thus greatly increasing the force of the shear without the need for a large high force over-center spring 30. As the contact point 52 is displaced from centerline 54 and the levers 46 and 24 move from being parallel to the centerline 54, this mechanical advantage is decreased as indicated by a steeper slope of function 66.

Figure 6:
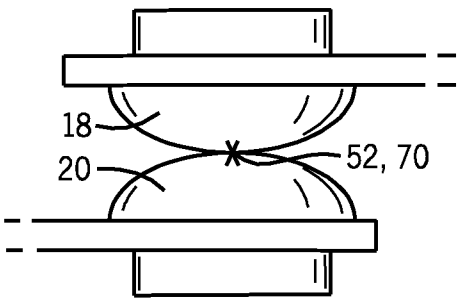
FIG. 6 an enlarged version of the detail of FIG. 4 showing a point contact between rounded faces of the upper and center contacts connected by a weld.

Referring now to FIGS. 5 and 6, as upper contact 18 is pulled downward with center contact 20 as a result of the weld 70, the lever 46 strikes the fulcrum wall 51 causing it to bend, moving the effective pivot point 50 to a new to pivot point 50' adjacent to the fulcrum wall 51. The result is an increased tipping or rolling of the upper contact 18 with respect to the center contact 20.

Figure 9:
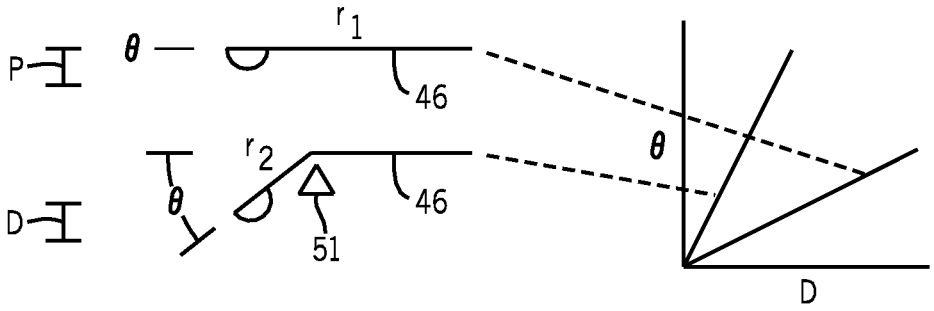
FIG. 9 is a chart showing a relative rolling of the contacts with respect to each other before and after the lever of the upper contact strikes a fulcrum point on the housing such as promotes a peeling apart of the contacts.

Referring momentarily to FIG. 9, the movement of the effective pivot point 50 to pivot point 50' decreases an effective radius of the lever 46 increasing a rate of change of relative angulation (A) between the contacts 18 and 20 with unison motion (D). Accordingly, if the initial shear generated between contact 18 and 20 does not release them, the action of the fulcrum wall 51 will tend to rotate the upper contact 18 to further separate the two by a peeling or prying action.

Figure 7:
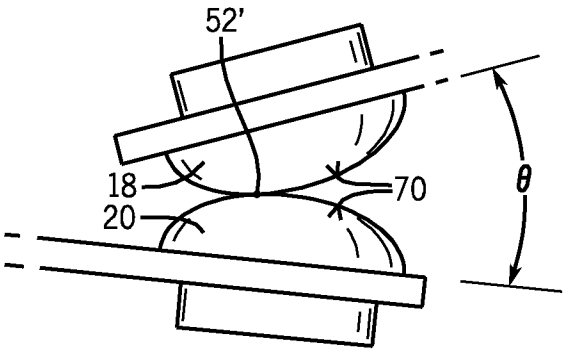
FIG. 7 is an enlarged version of the detail of FIG. 5 showing a rolling of the two contacts about a new contact point creating a leverage breaking of the weld.

Referring to FIGS. 6 and 7, in this peeling action, a weld 70 formed at contact point 52 between contacts 18 and 20 as shown in FIG. 6 will be pried apart as the contacts 18 and 20 rotate with respect to each other against a new contact point to 52' which serves as a mechanically advantaged fulcrum point for the separation of the weld 70.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. An electrical switch comprising:

a housing;

a first contact;

a second contact supported at a distal end of a first lever, the first lever movably supported by the housing to move the second contact under influence of a switch operator between a first position separated from the first contact and a second position contacting the first contact;

wherein the first contact is supported at a distal end of a second lever, the second lever movably supported by the housing to follow the second contact moving from the second position to the first position;

wherein proximal ends of the first and second levers are positioned in the housing to provide a shear force between the first and second contact when the first contact follows the second contact from the second position to the first position;

wherein the first and second levers are electrically conducting to provide an electrical path from the first and second contacts to corresponding conductors passing through the housing;

wherein the first lever is substantially rigid to rotate between the first and second position at a pivot point between the lever and a conductive support;

wherein the switch operator communicates with the first lever by means of an over-center spring operating to bias the first lever into engagement with the conductive support at the pivot point.

2. The electrical switch of claim 1 wherein the first and second levers pivot about effective first and second pivot points and wherein a contact between the first and second contacts at the second position lies substantially along a line between the first and second effective pivot points.

3. The electrical switch of claim 1 further including a third contact contacting the second contact when the second contact is in the first position.

4. The electrical switch of claim 1 wherein the housing is a moldable thermoplastic material.

5. The electrical switch of claim 1 wherein the second lever resiliently resists movement to follow the second contact moving from the second position to the first position absent a connection of the first and second contacts by welding.

6. The electrical switch of claim 5 wherein the second lever is a flexible metal strip affixed to the housing at the proximal end of the second lever and wherein movement from the second position to the first position flexes the metal strip to provide the resilient resistance of the second lever to follow the second contact.

7. The electrical switch of claim 1 wherein the second lever is a flexible metal strip affixed to the housing at the proximal end of the second lever; and wherein the housing provides a fulcrum wall contacting the second lever at a point between ends of the second lever when the first contact follows the second contact from the second position to the first position by a welding at the second position to tip the first contact with respect to the second contact by bending the second lever at the fulcrum wall.

8. The electrical switch of claim 7 wherein the first and second contacts are outwardly convex to contact at a point.

9. A method of operating an electrical switch having:

a housing;

a first contact;

a second contact supported at a distal end of a first lever, the first lever movably supported by the housing to move the second contact under an influence of a switch operator between a first position separated from the first contact and a second position contacting the first contact;

wherein the first contact is supported at a distal end of a second lever, the second lever movably supported by the housing to follow the second contact moving from the second position to the first position when the first and second contacts are connected by a welding;

wherein proximal ends of the first and second levers are positioned in the housing to provide a shear force between the first and second contact when the first contact follows the second contact from the second position to the first position by a welding at the second position;

wherein the first and second levers are electrically conducting to provide an electrical path from the first and second contacts to corresponding conductors passing through the housing;

wherein the first lever is substantially rigid to rotate between the first and second position at a pivot point between the lever and a conductive support;

wherein the switch operator communicates with the first lever by means of an over-center spring operating to bias the first lever into engagement with the conductive support at the pivot point, the method comprising the steps of:

(a) activating a switch operator to move the second contact from the first position to the second position to provide for electrical current flow between the first and second contacts to produce a welding between the first and second contacts; and (b) releasing the switch operator to cause the second contact to move from the second position to the first position to generate a shear force breaking the weld between the first and second contacts.

* * * * *